US005794267A

United States Patent [19]

Wallace

[11] Patent Number: 5,794,267

[45] Date of Patent: Aug. 18, 1998

[54] INTERACTIVE ARTICLES OF APPAREL WITH REMOVABLE AND INTERCHANGEABLE PANELS

[76] Inventor: Richard D. Wallace, 9801 W. 123rd St., Overland Park, Kans. 66213

[21] Appl. No.: 349,960

[22] Filed: Dec. 6, 1994

[51] Int. Cl.[6] ..... A41D 1/06

[52] U.S. Cl. ..... 2/227; 2/69; 2/115

[58] Field of Search ..... 2/227, 115, 102, 2/108, 69, 79, 94, 93, 85, 244, 246; 40/586; 383/4, 38–40; 150/103–105; 224/209, 211–213, 216

[56] References Cited

U.S. PATENT DOCUMENTS

| | | | |
|---|---|---|---|
| 2,527,258 | 10/1950 | Kahn . | |
| 2,647,261 | 8/1953 | Rassner . | |
| 2,871,485 | 2/1959 | Greco . | |
| 2,936,460 | 5/1960 | Jackson | 40/586 |
| 3,994,026 | 11/1976 | Sampey . | |
| 4,277,848 | 7/1981 | Boehland . | |
| 4,446,573 | 5/1984 | Green | 2/247 |
| 4,611,355 | 9/1986 | Galanto . | |
| 4,710,981 | 12/1987 | Sanchez . | |
| 4,875,237 | 10/1989 | Cohen . | |
| 4,924,613 | 5/1990 | Levin . | |
| 4,969,214 | 11/1990 | Cohen | 2/115 |
| 4,987,610 | 1/1991 | Hunt | 2/115 |
| 4,991,233 | 2/1991 | Hall | 2/115 |
| 4,999,848 | 3/1991 | Oney | 2/115 |
| 5,086,516 | 2/1992 | Baxter . | |
| 5,136,726 | 8/1992 | Kellin . | |
| 5,163,182 | 11/1992 | Fiveash . | |
| 5,379,461 | 1/1995 | Wilmers | 40/586 |

*Primary Examiner*—Gloria M. Hale

[57] ABSTRACT

An article of apparel having at least one outer panel (32) that can be manipulated to conceal or disclose one or more inner panels (34, 36,and 38) with exterior surfaces bearing indicia thereto. The panels have fixedly attached adhering strips of material, consisting of either a multiplicity of loops; a multiplicity of hooks and; a combination of both, in some instances. These strips releasably attach the panels to each other and to the garment, via a corresponding strip, fixedly attached to garment material (30).

55 Claims, 6 Drawing Sheets

INTERACTIVE ARTICLES OF APPAREL WITH REMOVABLE AND INTERCHANGEABLE PANELS

FIELD OF THE INVENTION

This invention relates to articles of apparel and more specifically, to apparel of which a person can interact by concealing and disclosing indicia or anything of choice that can be placed on removable and interchangeable panels.

BACKGROUND OF THE INVENTION

People seem to have an inherent need to express themselves. At times, gestures are far more effective at conveying the essence of one's sentiments, than as are words. Thus, we of contemporary times have witnessed the evolution of what could be claimed as a global institution. I am referring to the act commonly known as mooning. Although this gesture is at the very least risqué and may be offensive to some, it would be hard to deny that under certain conditions, it is an act that possesses vast humorous qualities to a great number of people. Therefore, it is the expressive, funny, and light side of humanity that the present invention hopes to appeal.

Prior art addresses societies appeal to garments that enable the wearer to: (1) express likes, dislikes and allegiances; (2) be versatile, in relation to removing and interchanging indicia subject matter; and (3) interact with apparel, by concealing or exposing indicia at a time deemed appropriate by the wearer. However, there is one major opportunity that past patents fail to address. There appears to be no prior art that offers a garment containing one unique and primary feature that enables the wearer to engage in a combination of all three of the above acts as a result of that particular feature.

In U.S. Pat. No. 4,710,981 (Sanchez), you see a garment that utilizes a panel to form a flap pocket. This pocket is permanently hinged to the body of the garment on one side and has adhering strips on the remaining unhinged sides of the flap pocket. The flap pocket allows the wearer to interact with the garment by concealing or exposing indicia. However, the lining, containing written indicia, is permanently attached to the insides of the flap pocket that is, in turn, permanently attached to the garment. The permanent, irremovable and non-interchangeable aspect of the indicia bearing device of this patent is a limitation that disallows versatility, which is a primary goal of the present invention.

In U.S. Pat. No. 5,136,726 (Kellin et al.), you see articles of apparel that are stretchable. All of their exposed surfaces are made of material comprised of a multiplicity of loop elements. Therefore, the wearer can removably attach decorative characters having a multiplicity of hook elements on their corresponding connecting surfaces. The Kellin patent has detachable, removable, and interchangeable features not found in the above mentioned Sanchez patent. However, it has the limitation of having the entire exterior surface of the garment being confined to one textured look. That look is furry-like and has the unfinished looking appearance, which is an inseparable quality of the loop element surface. Further, the Kellin patent does not possess a concealable feature for its decorative elements. Therefore, it is limited in garment versatility and in allowing wearer discretion, which also are important goals of the present invention.

In U.S. Pat. No. 5,163,182 (Fiveash), you see an article of apparel that employs the use of a dropseat panel. However, the primary objective of the Fiveash and other similar patents is to aid the wearer of the garment in addressing the needs that arise or are necessitated by bodily functions or biological demands. Therefore, the Fiveash and similar patents do not employ the features of removable, interchangeable and concealable panels. Nor, do they employ indicia bearing panels for the purpose of enabling the wearer to use the garment for engaging in decent expressive behavior, which is indeed a very important goal of the present invention.

SUMMARY OF THE INVENTION

The present invention discloses an article of apparel (for example, a pair of pants, a jacket, a pair of coveralls, etc.), which primarily features the combined use of outer and inner panels for the purpose of concealing, exposing, removing, changing, and bearing indicia, different colored material or different textured material. Thus, enabling the wearer to achieve all or any one of the above objectives through the same feature contained in a single article of apparel. Accordingly, along with the advantages and objectives stated above, several other objectives and advantages of the present invention are:

(a) to provide a garment which allows the wearer to engage in a less offensive form of the act of mooning, by not actually exposing body parts or skin when performing the act;

(b) to provide a garment which allows the wearer or other individuals to interact with the apparel;

(c) to provide a garment which contains a feature that expands the versatility aspect of that single garment;

(d) to provide a garment which allows the wearer to easily change or alter the apparel's expressive content, without the negative effects of damaging, compromising the structural integrity or aesthetic value of the garment, that usually accompanies having to change permanent features;

(e) to provide a garment which increases wearer's discretionary power by having a feature that grants the wearer: the option of concealing or exposing all or a select portion of indicia; the option of choosing from an unlimited amount of indicia subject matter; the option of changing indicia subject matter; the option of removing indicia and; the option of exposing one or a number of different indicia subject matters, at the same time;

(f) to provide a garment which can express one or more than one message, idea, thought, etc.

(g) to provide a garment which has the capacity to enable the wearer to also change the context of messages by manipulating the garment panels.

The objectives and advantages of the present invention, along with others as well, will become more apparent when taking into consideration the following descriptions and drawings.

BRIEF DESCRIPTION OF THE DRAWINGS

In the drawings.

FIG. 1 shows an isometric rear view of the invention in the embodiment of a pair of pants with the outer flap panel in a partially opened position.

FIG. 2 shows an isolated view of the exterior side of the inner panel of FIG. 1 with the interior side slightly folded over.

FIG. 3 shows a cross-sectional view along line 1—1 of FIG. 1.

FIG. 4 shows an isometric rear view of a different variation of the invention in the embodiment of a pair of pants with the outer flap panel in a partially opened position.

FIG. 5 shows an isolated view of the exterior side of the inner panel of FIG. 4 with the interior side slightly folded over.

FIG. 6 shows a cross-sectional view along line 2—2 of FIG. 4.

FIG. 7 shows an isometric rear view of another variation of the invention in the embodiment of a pair of pants with the outer flap panel in a partially opened position.

FIG. 8 shows an isolated view of the exterior side of the inner panel of FIG. 7 with the interior side slightly folded over.

FIG. 9 shows a cross-sectional view along line 3—3 of FIG. 7.

FIG. 10 shows an isometric rear view of still another variation of the invention in the embodiment of a pair of pants with the outer flap panel in a partially opened position.

FIG. 11 shows an isolated view of the exterior side of the inner panel of FIG. 10 with the interior side slightly folded over.

FIG. 12 shows a cross-sectional view along line 4—4 of FIG. 10

FIG. 13 shows an isometric rear view of yet another variation of the invention in the embodiment of a pair of pants with the outer flap panel in a partially opened position.

FIG. 14 shows an isolated view of the exterior side of the second inner panel of FIG. 13 with the interior side slightly folded over.

FIG. 15 shows a cross-sectional view along line 5—5 of FIG. 13

FIG. 16 shows an isometric view of the invention in the embodiment of a jacket.

FIG. 17 shows an isometric view of the invention in the embodiment of a gym bag.

FIG. 18 shows an isometric view of the invention in the embodiment of a back pack.

List of Reference Numerals in Drawings

Figure 1:
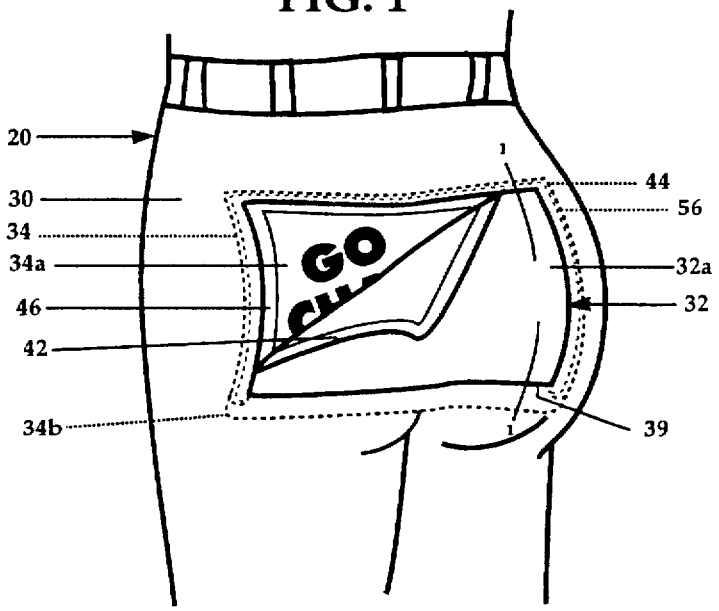
FIGS. 1,4,7,10 & 13 are all rear views of the invention shown in the embodiment of pants.

20 pants
30 garment material
32 outer flap panel
**32*a*** flap panel material
**34*b*** inner panel type I (tail type adhering strips on exterior side)
35 centerpoint
36 inner panel type II (adhering strips on interior side)
**36*a* material inner panel 36**
37 radius distance I (between lowest point of outer-peripheral strip 44 and centerpoint 35)
**37*a* radius distance II (between outer-peripheral strip 44 and centerpoint 35**)
**37*b* radius distance III (between inner-perimeter strip 46 and centerpoint 35**)
38 inner panel type II (no tail - adhering strip on the exterior side, completely encompasses the panel)
**38*a* material -- inner panel 38**
39 permanent flap hinge
40 strip ( multiplicity of loop elements) on exterior of garment material 30
42 strip (multiplicity of hook elements) on interior of outer flap panel 32
44 outer-peripheral strip (multiplicity of hook elements) on exterior side of inner panel -- types I & III
46 inner-perimeter strip (multiplicity of loop elements) on exterior side of inner panel -- types I & III
48 upper parallel strip (multiplicity of loop elements) on exterior side of inner panel -- types I & III
50 lower parallel strip (multiplicity of loop elements) on exterior side inner panel -- types I & III
52 upper parallel strip (multiplicity of hook elements) on interior side of inner panel -- type II
54 lower parallel strip (multiplicity of hook elements) on interior side of inner panel -- type II
56 strip (multiplicity of loop elements) on interior of garment material 30
58 upper parallel strip (multiplicity of loop elements) on exterior of garment material 30
60 lower parallel strip (multiplicity of loop elements) on exterior of garment material 30
62 aperture of garment material 30

DETAIL DESCRIPTIONS OF THE DRAWINGS

For the purpose of effectuating clear understanding, specific terminology will be utilized in the following descriptions. However, each specific term so used, should be interpreted as including all technical equivalents that function in a similar manner, to achieve similar results. Therefore, the present invention is not intended to be limited to the specific terms utilized in these descriptions.

As shown in FIGS. 1, 4, 7, 10 & 13, the present invention, "INTERACTIVE ARTICLE OF APPAREL WITH REMOVABLE AND INTERCHANGEABLE PANELS", is an article of apparel. In these instances, a pair of pants 20 made of garment material 30 and has an outer flap panel 32 made of a similar material **32*a*. The outer flap panel 32 is used to conceal or disclose, at the discretion of the wearer, inner panels 34, 36, 38 or some combination thereof, all of which are capable of bearing indicia. In all figures where applicable, inner panel 34 will be of type I construction (tail type—adhering strips on exterior side); inner panel 36 will be of type II construction (adhering strips on interior side) and; inner panel 38** will be of type III construction (no tail—adhering strip on the exterior side, completely encompasses the panel)

FIG. 1 is a rear view of pants 20, illustrating the general construction of the present invention. Outer flap panel 32 is sewn to garment material 30 to form a permanent flap hinge 39, at the lower horizontal edge of outer flap panel 32. The remaining three edges of the outer flap panel 32 have adhesive strip 42, comprised of a multiplicity of hook elements, fixedly adhered to the interior of flap panel material **32*a*, by using fabric glue and sewing. Strip 42 releasably joins outer flap panel 32 to inner panel 34. This is done by connecting strip 42 to inner perimeter strip 46 on inner panel 34. Inner-perimeter strip 46 is comprised of a multiplicity of loop elements and is fixedly adhered to the exterior side of inner panel material 34*a*, using fabric glue and sewing. Inner panel 34 has a second adhesive strip, outer-peripheral strip 44, comprised of a multiplicity of hook elements. Outer-peripheral strip 44 is fixedly adhered, using fabric glue and sewing, to three edges (the top horizontal edge and the two vertical edges) on the exterior side of inner panel material 34*a*. The tail portion 34*b* of inner panel 34 is actually formed by and is that part of inner panel material 34*a* that extends below strip 44 down to the lowest edge of inner panel 34. Strip 56 is a three edged adhesive strip that corresponds to strip 44 and is comprised of a multiplicity of loop elements, fixedly attached, using fabric glue and sewing, to the interior side of the garment material 30 of pants 20**.

Figure 2:
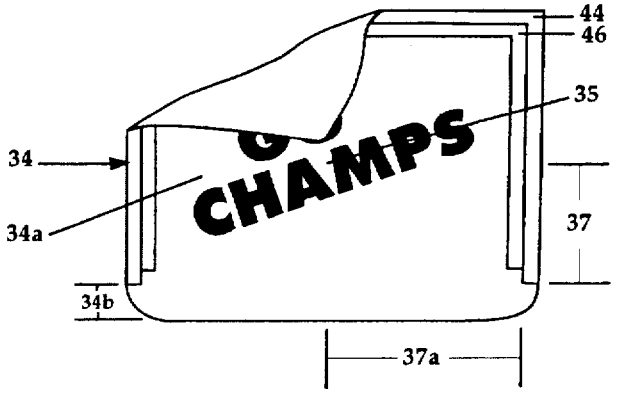
FIGS. 2,5,8,11 & 14 are individual views of the inner panel components relating to their respective figures above. Likewise

In FIG. 2, inner panel 34 is shown in an isolated view. This illustrates that inner panel 34 has a centerpoint 35, a radius distance 37 (located between the lowest point of outer-peripheral strip 44 and centerpoint 35), and a second radius distance 37*a* (located between outer-peripheral strip 44 and centerpoint 35). An adhesive strip, outer-peripheral strip 44, is glued and sewn to the top horizontal edge and the two vertical side edges, on the exterior side of inner panel material 34*a*. A second adhering strip, inner-perimeter strip 46 is glued and sewn immediately adjacent to outer-peripheral strip 44. Note that the two vertical segments of outer-peripheral strip 44 are slightly longer than the vertical segments of inner-perimeter strip 46. This is to accommodate outer-peripheral strip 44 extending slightly below the horizontal plane of permanent hinge 39 (shown in FIG. 1), when inner panel 34 is attached to pants 20 (also shown in FIG. 1). The remaining surface of inner-panel material 34*a* on the exterior side of the inner panel 34, is for the purpose of bearing indicia, or different colored material, or different textured material of the wearer's choice. Inner panel 34 has a tail portion 34*b* which is a continuation of inner panel material 34*a*. Tail portion 34*a* extends downward substantially below the horizontal plane of permanent flap hinge 39 (shown in FIG. 1), when inner panel 34 is attached to pants 20 (shown in FIG. 1). The tail portion 34*b* provides a way of preventing the wearer's skin or underwear from being exposed to the view of others when outer flap panel 32 of FIG. 1 is in the opened position.

Figure 3:
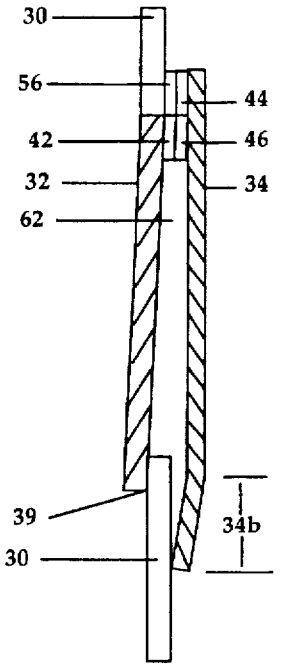
FIGS. 3,6,9,12 &15 are cross-sectional views relating to their respective figures above.

FIG. 3 is a cross-sectional view along line 1—1 of FIG. 1 showing the connecting relationship of: outer-peripheral strip 44 on inner panel 34 to strip 56 on garment material 30 and; inner-perimeter strip 46 on inner-panel 34 to strip 42 on outer flap panel 32. FIG. 3 also shows the position relationship of: aperture 62 to outer flap panel 32 and to inner panel 34 and; tail portion material 34*b* to permanent flap hinge 39.

Figure 4:
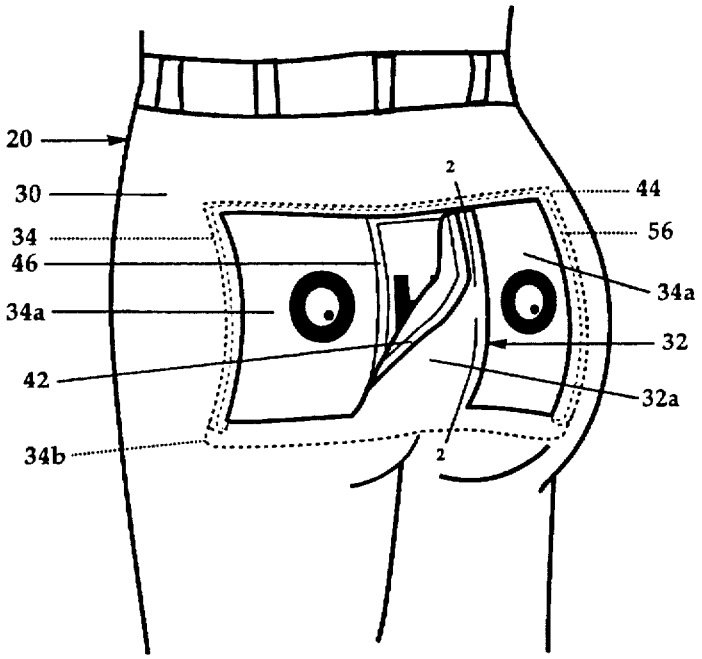

As shown in FIG. 4, the construction of this representation of the present invention is similar to that of FIG. 1, with some variations. One notable difference is that outer flap material 32*a* is a continuation or extension of that portion of garment material 30 which makes up the rear section of pants 20. Another difference is that outer flap panel 32 is smaller in size horizontally, resulting in it having a smaller top horizontal segment on strip 42. The smaller outer flap panel also results in partial sections of the exterior of inner panel material 34*a* being consistently exposed to view, on either side of flap panel material 32*a*. This exposure is consistent even when outer flap panel 32 is in the upright and closed position. Another exception is that the inner-perimeter strip 46 of inner panel 34 also has a substantially smaller top horizontal segment, enabling it to correspondingly match the reduced size of strip 42 on outer flap panel 32. As in FIG. 1, tail portion 34*b* in FIG. 4 is also formed by and is that part of inner panel material 34*a* that extends below strip 44 down to the lowest edge of inner panel 34. Likewise, strip 56 is also a three edged adhesive strip that corresponds to strip 44 and is comprised of a multiplicity of loop elements, fixedly attached, using fabric glue and sewing, to the interior side of the garment material 30 of pants 20.

Figure 5:
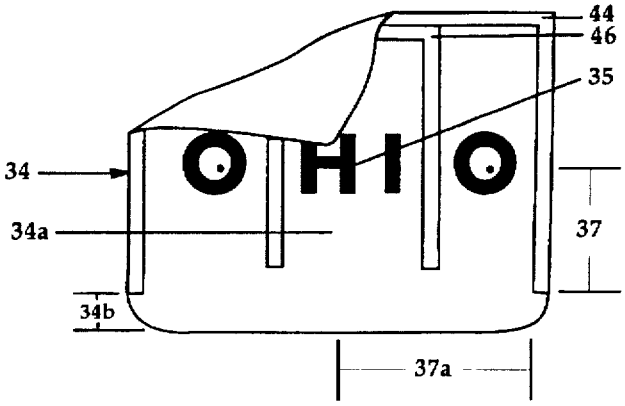

FIG. 5 is an isolated view of inner panel 34 of FIG. 4, illustrating that it has a centerpoint 35, a radius distance 37 (located between the lowest point of outer-peripheral strip 44 and centerpoint 35), and a second radius distance 37*a* (located between outer-peripheral strip 44 and centerpoint 35). In addition, FIG. 5 also illustrates a variation in the construction of inner panel 34 compared to that of the inner panel in FIG. 2. As seen in FIG. 5, the configuration of inner perimeter strip 46 on this inner panel, is such that it has a smaller top horizontal segment than that of the inner panel in FIG. 2. Otherwise, outer peripheral strip 44, inner panel material 34*a* and tail portion material 34*b* are exactly the same as in FIG. 2.

Figure 6:
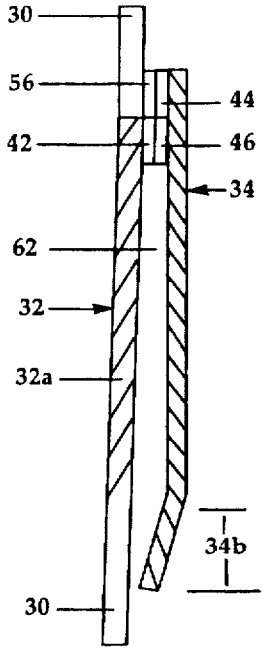

FIG. 6 shows that the cross-sectional view along line 2—2 of FIG. 4 is similar to the cross-sectional view in FIG. 3. The one exception is that the body of inner panel 32 in FIG. 6, formed by inner panel material 32*a*, in this instance is actually a continuation of garment material 30. FIG. 6, also shows the connecting relationship of: outer-peripheral strip 44 on inner panel 34 to strip 56 on garment material 30 and; inner-perimeter strip 46 on inner-panel 34 to strip 42 on outer flap panel 32. In addition FIG. 6 shows the position relationship of: aperture 62 to outer flap panel 32 and inner panel 34 and; tail portion material 34*b* to inner panel 34.

Figure 7:
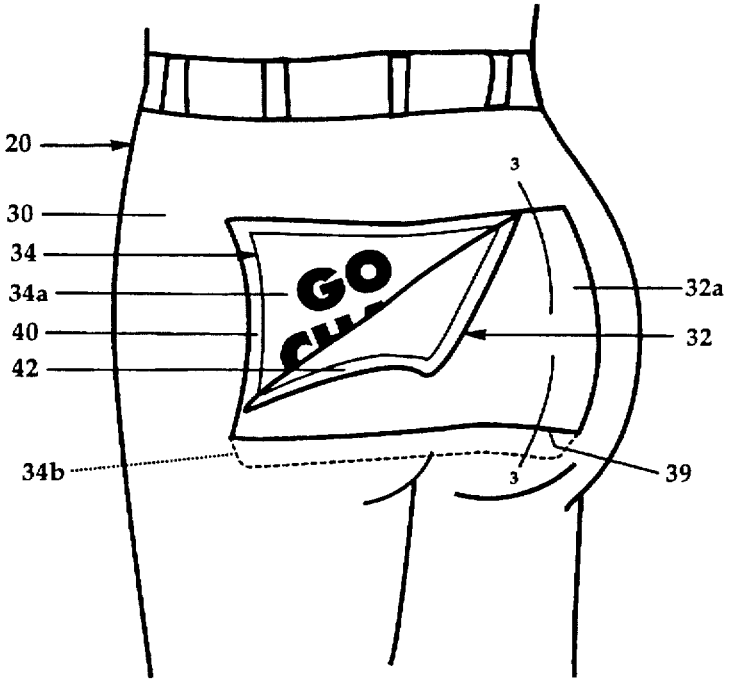

In FIG. 7, the construction of this representation of the present invention is also similar to that of FIG. 1, with the following exceptions. Strip 42 (a multiplicity of hook elements) on the interior of flap panel material 32*a* of outer flap panel 32, now releasably attaches to the strip 40 (a multiplicity of loop elements) which is glued and sewn to the exterior surface of garment material 30 of pants 20. In this instance, strip 40 on garment material 30 is actually a three sided frame that has two vertical sides and one upper horizontal side to correspondingly match the sides of strip 42 on outer flap panel 32. Another exception is that inner panel 34 has only one (1) adhering strip (outer-peripheral strip 44 shown in FIGS. 8 & 9) attached to the exterior of inner panel material 34*a*. Like the tail portion of the inner panel in FIG. 1, tail portion 34*b* in FIG. 7 is also an extension of inner panel material 34*a*. In addition, permanent flap hinge 39 is also created by outer flap panel 32 being sewn to garment material 30.

Figure 8:
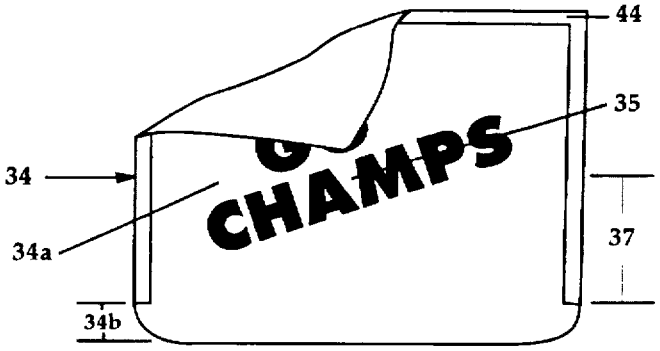

FIG. 8 shows an isolated view of inner panel 34 of FIG. 7, illustrating that it has a centerpoint 35, a radius distance 37 (located between the lowest point of outer-peripheral strip 44 and centerpoint 35) and that it is very similar in construction to the inner panel in FIG. 2. The only difference is that inner panel 34 in FIG. 7 has only one (1) adhering strip, outer peripheral strip 44, a multiplicity of hook elements. Otherwise, inner panel material 34*a* and tail portion material 34*b* are exactly the same as in FIG. 2.

Figure 9:
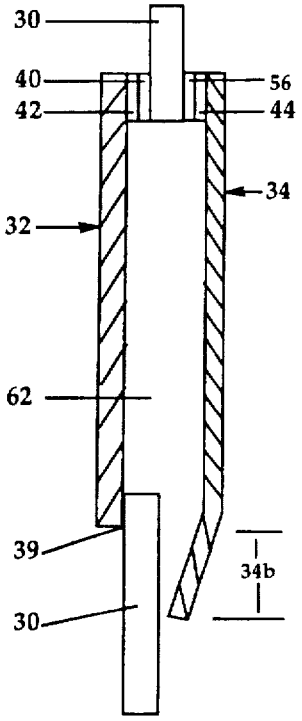

FIG. 9 is the cross-sectional view along line 3—3 of FIG. 7, showing the connecting relationship of: outer-peripheral strip 44 on inner panel 34 to strip 56 on the interior of garment material 30 and; strip 42 on outer flap panel 32 to strip 40 on the exterior of garment material 30. FIG. 9 also shows the position relationship of: aperture 62 to outer flap panel 32 and to inner panel 34 and; tail portion material 34*b* to permanent flap hinge 39.

Figure 10:
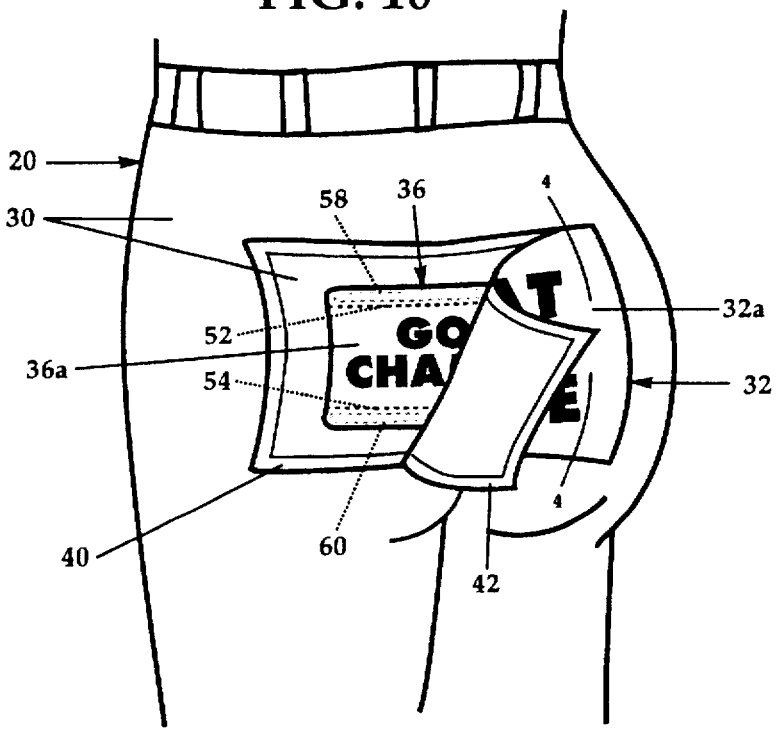

As shown in FIG. 10, the construction of this representation of the present invention is slightly different. Unlike FIGS. 1,4,7 & 13, in this instance there is no aperture created in the buttocks area of pants 20. Instead garment material 30 covers the entire buttocks area with strip 40, a multiplicity of loop elements, glued and sewn to its exterior side. Strip 40 is a rectangular frame, constructed so that it corresponds to the shape of strip 42, a multiplicity of hook elements, on outer flap panel 32. Another difference is that outer flap panel 32 in this instance has indicia on its exterior surface. It also has an adhering strip, strip 42, that is glued and sewn to the entire periphery of its interior edges, completely encompassing the interior side of flap panel material 32*a*. This feature enables outer flap panel 32 to be manipulated in a hinge-like manner on all sides. This is accomplished by just leaving one of the adhering segments of strip 42 attached to a corresponding adhering segment of strip 40, while releasing the other three segments. Also, outer flap panel 32 can be completely removed from pants 20 because it has no sides fixedly attached to the garment. In both instances, (hinging or removing) inner panel 36 will be exposed to view. Within the frame created in the buttocks area of pant 20 by strip 40, two parallel strips are fixedly attached. They are upper parallel strip 58 and lower parallel strip 60. Both strips 58 and 60 are a multiplicity of loop elements and are glued and sewn to the exterior of garment material 30. Inner panel 36 has a corresponding set of parallel strips. They are upper parallel strip 52 and lower parallel strip 54. Both strips are a multiplicity of hook elements and are glued and sewn to the interior side of inner panel material 36*a*. The above parallel strips enable inner panel 36 to be releasably attached to garment material 30 of pants 20. This is done by simply applying enough pressure to cause the bonding action of strip 52 to strip 58 and strip 54 to strip 60. A reverse pulling pressure will effectuate the detachment of inner panel 36.

Figure 11:
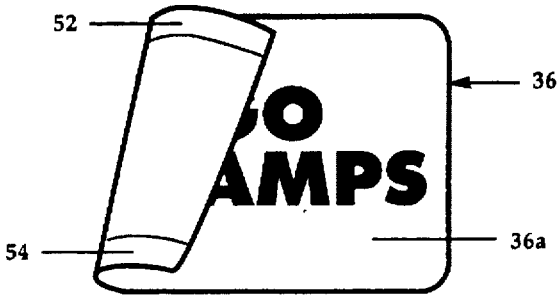

FIG. 11 is an isolated view of the exterior side of inner panel 36 of FIG. 10 with part of its interior side bent forward. This illustrates that inner panel 36 is constructed differently from the other inner panels. In this instance, the adhering strips are fixedly attached to the interior of the inner panel. Thus, leaving the entire exterior surface of inner panel 36*a* available for indicia bearing purposes. The adhering strips, upper parallel strip 52 and lower parallel strip 54 are a multiplicity of hook elements. They are positioned parallel to each other and are glued and sewn to the interior edges of inner panel 36.

Figure 12:
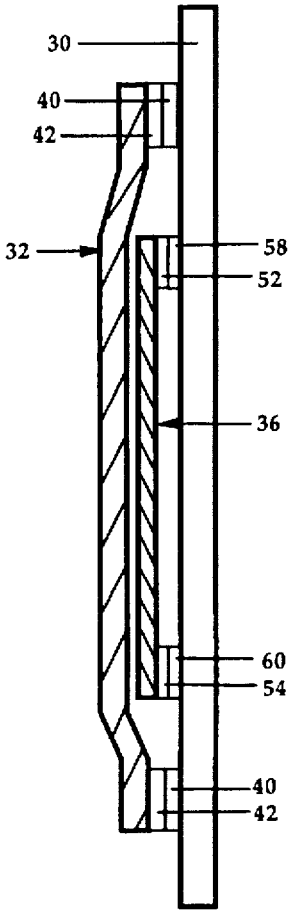

FIG. 12 is a cross-sectional view along line 4—4 of FIG. 10 showing the connecting relationships of: strip 40 on garment material 30 to strip 42 on outer flap panel 32 and; strips 52 and 54 on inner panel 36 to their corresponding strips 58 and 60 on garment material 30. Also shown in this illustration, is the fact that both outer flap panel 32 and inner panel 36 releasably attach to the exterior side of garment material 30. This is a differentiating feature of this representation of the present invention.

Figure 13:
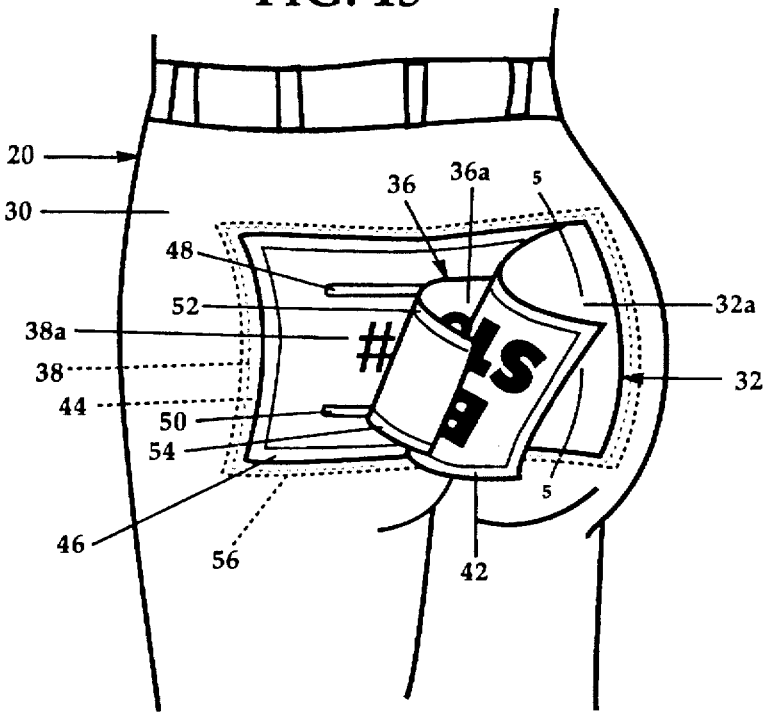
Figure 14:
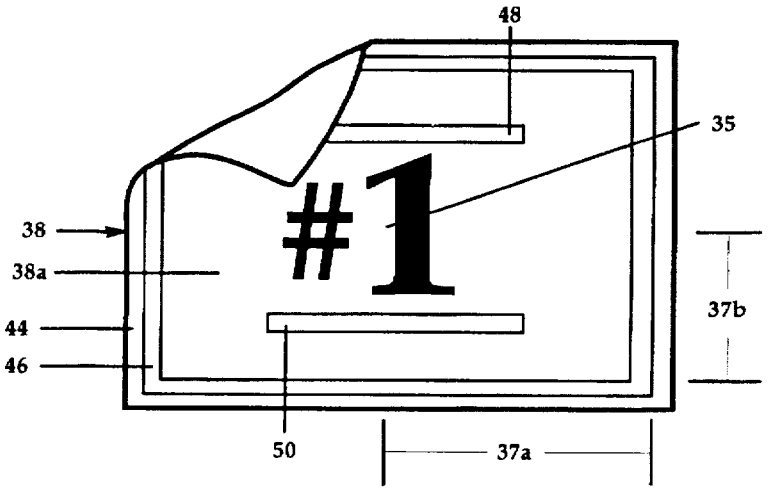

FIG. 13 shows another variation of the present invention in an attempt to illustrate the invention's great versatility and potential for change. This is accomplished by combining and utilizing some exact features and some similar features of those examples in the previously shown figures. The construction of FIG. 13 features a void (aperture 62, shown in FIG. 15) in the area of the buttocks of Pants 20, as do FIGS. 1, 4 & 7, as shown in FIGS. 3, 6 & 9. It also features an outer flap panel 32, with a completely encompassing adhering strip, strip 42, fixedly attached to the interior of flap panel material 32*a*; and an inner panel 36, with two parallel adhering strips, strips 52 and 54, fixedly attached to the interior side of inner panel material 36*a*, as does FIG. 10. However, instead of having outer flap panel 32 and inner panel 36 releasably attach to the body of pants 20, in this instance, they releasably attachable to a second inner panel. The second inner panel employed in FIG. 13 is inner panel 38, comprised of inner panel material 38*a*, upper parallel strip 48, lower parallel strip 50, outer-peripheral strip 44, and inner-perimeter strip 46. Inner panel 38 is crucial to the panel to garment body connection design and solely enables this connection to be completed by its capacity to releasably attach to the interior of pants 20. This is done by compressing outer-peripheral strip 44 on inner panel 38 to corresponding strip 56 on the interior side of garment material 30 of pants 20. Outer flap panel 32 in FIG. 13 shows even more invention versatility by having indicia grace its interior surface FIG. 14 is an isolated view of inner panel 38 of FIG. 13. It illustrates that inner panel 38 has a centerpoint 35, a radius distance 37*a* (located between outer-peripheral strip 44 and centerpoint 35), and a second radius distance 37*b* (located between inner-peripheral strip 46 and centerpoint 35). Outer-peripheral strip 44, a multiplicity of hook elements, is glued and sewn adjacent to the outermost edges of the exterior side of inner panel material 38*a* and completely encompasses inner panel 38. It also has inner-perimeter strip 46, a multiplicity of loop elements, glued and sewn immediately adjacent to all inward sides of strip 44, on the exterior side of inner panel material 38*a*. Finally, upper parallel strip 48 and lower parallel strip 50, both a multiplicity of loop elements, are glued and sewn in a horizontal position paralleled to each other, within the perimeter of strip 46. The exterior side of inner panel 38, also bear's indicia, different colored material, different textured material, or any combination of indicia, colored material, or textured material, according the wearer's preference.

Figure 15:
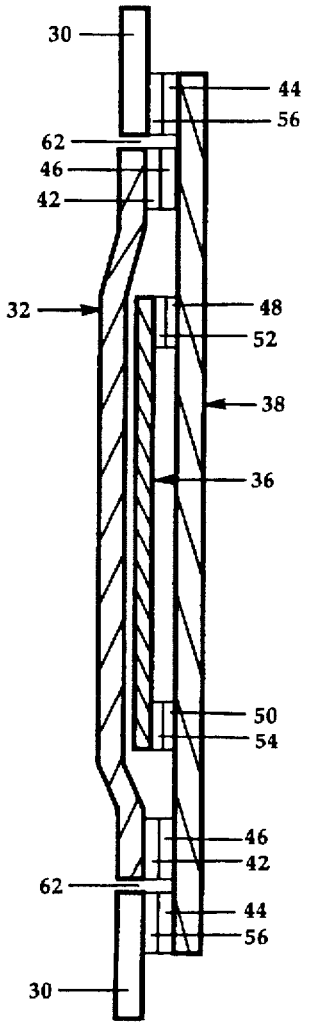

FIG. 15 is a cross-sectional view along Line 5—5 of FIG. 13 showing the connecting relationship of: outer-peripheral strip 44 on inner panel 38 to strip 56 on garment material 30; inner-perimeter strip 46 on inner panel 38 to strip 42 on outer flap panel 32; upper parallel strip 48 and lower parallel strip 50 on inner panel 38 to upper parallel strip 52 and lower parallel strip 54 on inner panel 36. Also shown, is the relationship between aperture 62 of pants 20 to panels 32, 36, 38 and garment material 30.

Figure 16:
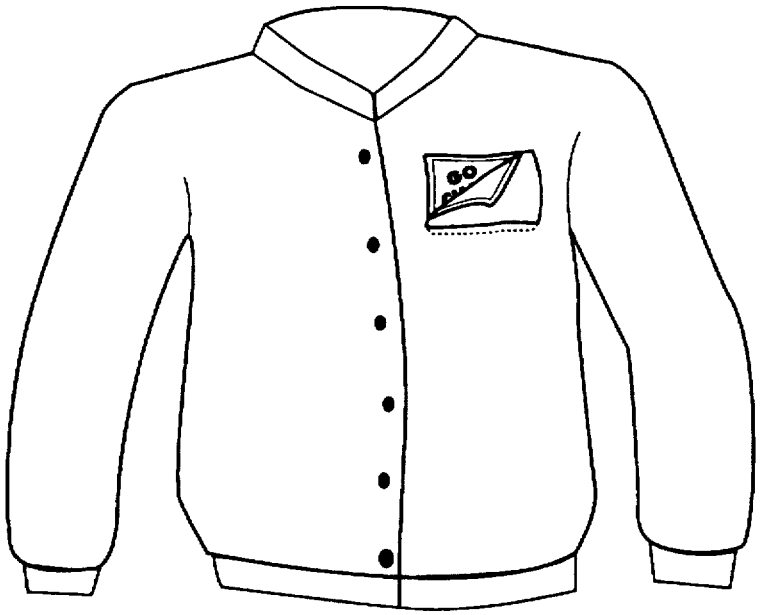
FIGS. 16,17 & 18 show the present invention in alternate embodiments.

FIG. 16 shows the present invention in the embodiment of a jacket.

Figure 17:
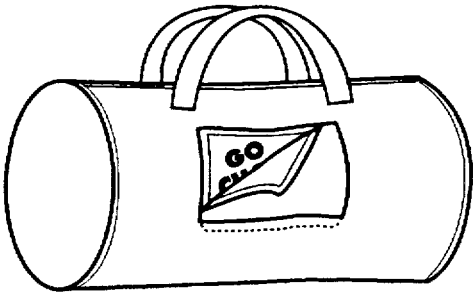

FIG. 17 shows the present invention in the embodiment of a gym bag.

Figure 18:
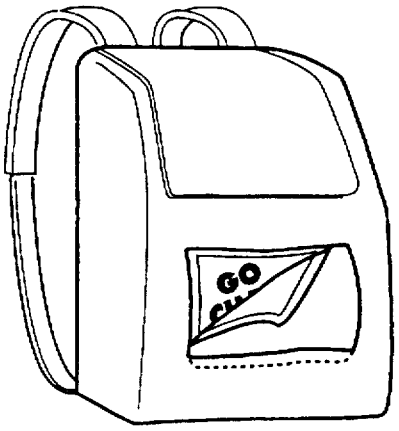

FIG. 18 shows the present invention in the embodiment of a back pack.

OPERATIONAL DESCRIPTION OF DRAWINGS

As seen in the above Figures, the present invention operates in basically the same manner in all instances. That is with the wearer opening and closing outer flap panel 32, to disclose or conceal the indicia contained on inner panels 34, 36, and/or 38. The panel opening process is accomplished by the wearer pulling outward on outer flap panel 32. Sufficient pressure must be applied to break the releasable bond of adhering strip 42 on outer flap panel 32, away from; adhering strip 40 on garment material 30 (as seen in FIGS. 7 and 10) or; inner-perimeter strip 46 on inner panel 34 (as seen in FIGS. 1 and 4) or; inner-perimeter strip 46 on inner panel 38 (as seen in FIG. 13).

Accordingly, the closing process simply entails reversing the action described above and supplying sufficient pressure to now cause the bonding of the respective adhering strips. The process of removing and replacing the inner panels entails executing the above steps, with one additional step applicable when using inner panels 34 or 38. In these cases, the garment must be taken off or dropped down to the extent which allows access to the garment body interior. This additional step is necessary because inner panels 34 and 38 must be pulled inward to break their adhering bonds. These bonds are created by outer-peripheral strip 44 on inner panels 34 and 38, releasably attaching to adhering strip 56 on the interior of garment material 30 (as seen in FIGS. 1, 4, 7, and 13).

In FIGS. 1, 4, 7, 10 and 13, the garment body is a pair of pants. These particular embodiments enable the wearer to engage in a decent or at least less indecent act of mooning. The wearer merely turns his/her backside towards the intended target, opens outer flap panel 32, bends at the waist and projects a display of indicia contained on the applicable inner panel being utilized to cover the wearer's buttocks.

Various other modifications of the present invention will be apparent to those skilled in the art. For example, instead of rectangular panels, a circular, heart shaped, oblong, or diamond-shaped panel may be used. Also, along with any number of different shapes being available for use, a number of different size panels can be used. When these panel options are combined with the numerous garments that can be utilized, an enormous amount of variations of the present invention becomes available to those skilled in the art. Thus the scope of the invention should be determined by the appended claims and their legal equivalents, rather than by the examples given.

I claim:

1. An interactive article of apparel comprised, in combination of:

a garment constructed of a material having an inside surface and an outside surface with an opening therethrough;

said opening having at least one fastening means around a periphery of the opening on said inside surface providing a means of attaching objects to the inside surface of said garment;

said opening having at least one fastening means around a periphery of the opening on said outside surface providing a means of attaching objects to the outside surface of said garment.

2. The invention as claimed in claim 1, wherein said interactive article of apparel further includes:

at least one outer panel having an inside and an outside periphery and constructed of a material having an inside surface and an outside surface; said outer panel having at least one fastening member around its inside periphery that is complimentary to a fastening member on said garment's outside surface wherein said outer panel is hingedly attached to the garment by said garment's outside surface fastening means, to at least partially cover said opening.

3. The invention as claimed in claim 2, wherein said interactive article of apparel further includes:

at least one inner panel having an interior surface and an exterior surface and an interior and exterior periphery;

said inner panel having at least one fastening member around its exterior periphery to releasably attach said inner panel to a corresponding fastening member of said fastening means around the periphery of the opening on the inside surface of the garment, thereby attaching said inner panel to the garment.

4. The invention as claimed in claim 3, wherein said interactive article of apparel further includes:

said at least one inner panel's exterior surface providing a means for bearing indicia, a different colored surface or different texture than said garment's outside surface at the wearer's preference;

said inner panel being removable and replaceable with other inner panels and thereby changing said indicia, color or texture of said garment at the area of the garment where the inner panel is attached;

said inner panel being covered and uncovered by said outer panel and is positioned adjacent to the inside surface of said outer panel when both said inner panel and said outer panel are attached to said garment and said outer panel is in a closed position.

5. The invention as claimed in claim 4, wherein said inner panel is comprised of:

a material having at least one centerpoint, at least one radius distance and an outermost edge;

said at least one fastening member fixedly secured to said material in a designated area, which is located at some point adjacent to the outermost edge of the exterior surface of said inner panel.

6. The invention as claimed in claim 5, wherein said inner panel has a tail portion of said material that extends downward, in excess of said at least one radius distance, created by moving from said at least one centerpoint of said inner panel to a lowest point of said at least one fastening member.

7. The invention as claimed in claim 5, wherein said outer panel has one edge that is free of a fastening member and is fixedly attached to said garment, forming a permanent hinge.

8. The invention as claimed in claim 1, wherein said interactive article of apparel further includes:

at least one outer panel having an inside and outside periphery and constructed of a material having an inside surface and an outside surface; said outer panel having at least one fastening member around its inside periphery that is complimentary to a fastening member on an inner panel;

at least one inner panel having an interior surface and an exterior surface and an interior and exterior periphery;

said at least one inner panel having at least one fastening member around an exterior periphery to releasably attach said inner panel to a corresponding fastening member of said fastening means on the inside surface of said garment opening, thereby attaching said inner panel to the garment;

said at least one inner panel having at least a second fastening member on its exterior surface to releasably attach the inner panel to a complementary fastening member on said outer panel whereby the outer panel is hingedly attached to said inner panel to at least partially cover said opening when the inner panel is attached to said garment;

said inner panel being covered and uncovered by said outer panel and is positioned adjacent to the inside surface of said outer panel when said outer panel is attached to said inner panel in a closed position.

9. The invention as claimed in claim 8, wherein said inner panel is comprised of:

a material having at least one centerpoint, at least one radius distance and an outermost edge;

said at least one fastening member fixedly secured to said material in a first designated area, which is located at some point adjacent to the outermost edge of the exterior surface of said inner panel and;

said at least a second fastening member fixedly secured to the exterior surface of said material in a second designated area, which is located at some point on said at least one radius distance created between the fastening member in the first designated area and said at least one centerpoint of said inner panel.

10. The invention as claimed in claim 9, wherein said inner panel has a tail portion of said material that extends downward, in excess of a second radius distance created by moving from a centerpoint of said inner panel to a lowest point of the fastening member in the first designated area.

11. The invention as claimed in claim 9, wherein said inner panel further includes:

at least a third fastening member fixedly secured to the exterior surface of said material in a third designated area, which is located at some point on a third radius distance created between the fastening member in the second designated area and a centerpoint of said inner panel.

12. The invention as claimed in claim 11, wherein said inner panel further includes:

at least one additional inner panel constructed of a material having an interior surface and an exterior surface;

said additional inner panel's exterior surface providing a means for bearing indicia, a different colored surface or different texture than said inner panel's exterior surface or said garment outside surface at the wearer's preference;

said additional inner panel having at least one fastening member fixedly secured to its interior surface to releasably attach said additional inner panel to a corresponding fastening member on said inner panel's exterior surface.

13. The invention as claimed in claim 8, wherein said outer panel has one edge that is free of a fastening member and is fixedly attached to said garment, forming a permanent hinge.

14. The invention as claimed in claim 8, wherein said outer panel has a material that is a continuation and extension of said garment material forming the periphery and a body of said outer panel.

15. The invention as claimed in claim 8, wherein said outer panel has a fastening member that is fixedly attached to its inside periphery and completely encompasses said outer panel.

16. The invention as claimed in claim 8, wherein said outer panel has an inside surface providing a means for bearing indicia, a different colored material or a different textured material than said garment's outside surface at the wearer's preference.

17. The invention as claimed in claim 1, wherein said garment is a pair of pants.

18. The invention as claimed in claim 1, wherein said garment is a jacket.

19. An interactive article of apparel comprised, in combination of:

a garment constructed of a material and having an inside surface and an outside surface;

said garment having at least one first fastening means fixedly attached to said outside surface and said first fastening means is straddled by at least a second fastening means;

said garment having at least one second fastening means fixedly attached to said outside surface, with at least one fastening member that angles or bends and ultimately provides said second fastening means with a frame shape that would be necessary for its shape to eventually surround said first fastening means and whereby said second fastening means' frame shape is located around said first fastening means;

at least one panel having an inside and outside periphery and constructed of a material having an inside surface and an outside surface and at least one fastening member around its periphery on the inside surface, that is complimentary to at least one of the said fastening means on said garment's outside surface, whereby said panel is hingedly attached to the garment by one of the said fastening means.

20. The invention as claimed in claim 19, wherein said at least one panel is:

an outer panel having said at least one fastening member around its periphery on the inside surface complimentary to said second fastening means on said garment's outside surface, whereby said outer panel is hingedly attached to the garment by said second fastening means.

21. The invention as claimed in claim 20, wherein said interactive article of apparel further includes:

at least one inner panel having an interior surface and an exterior surface;

said inner panel having at least one fastening member on its interior surface that is complementary to said first fastening means on said garment's outside surface, thereby releasably attaching said inner panel to the garment in a position that is adjacent to the inside surface of said outer panel and that is at least partially covered by said outer panel when the outer panel is attached to said garment in a closed position.

22. The invention as claimed in claim 21, wherein said outer panel has an outside surface providing a means for bearing indicia, a different colored surface or different texture than said garment's outside surface at the wearer's preference.

23. The invention as claimed in claim 22, wherein said inner panel has an exterior surface providing a means for bearing indicia, a different colored surface or different texture than said garment's outside surface at the wearer's preference.

24. The invention as claimed in claim 23, wherein said inner panel is removable and replaceable with other inner panels and;

said inner panel being covered and uncovered by said outer panel, removed and replaced by other inner panels thereby changing said indicia, color or texture of said garment at the area of the garment where the inner panel is attached.

25. The invention as claimed in claim 19, wherein said second fastening means at least partially surrounds said first fastening means.

26. The invention as claimed in claim 19, wherein said second fastening means completely surrounds said first fastening means.

27. The invention as claimed in claim 20, wherein said outer panel has one edge that is free of a fastening member and is fixedly attached to said garment forming a permanent hinge.

28. The invention as claimed in claim 20, wherein said outer panel has at least one fastening member that is fixedly attached to its inside periphery and completely encompasses said outer panel.

29. The invention as claimed in claim 20, wherein said outer panel has an inside surface providing a means for bearing indicia, a different colored material or a different texture than said garment's outside surface and said inner panel's exterior surface at the wearer's preference.

30. The invention as claimed in claim 19, wherein said at least one panel has:

at least one fastening member on its inside surface that is complementary to said first fastening means on said garment whereby said panel is hingedly attached to the garment's outside surface.

31. The invention as claimed in claim 19, wherein said garment is a pair of pants.

32. An interactive article carried by an individual comprised, in combination of:

a container constructed of a material having an inside surface and an outside surface with an opening therethrough;

said opening having at least one fastening means around a periphery of the opening on said inside surface providing a means of attaching objects to the inside surface of said container;

said opening having at least one fastening means around a periphery of the opening on said outside surface, providing a means of attaching objects to the outside surface of said container.

33. The invention as claimed in claim 32, wherein said interactive article carried by an individual further includes:

at least one outer panel having an inside and an outside periphery and constructed of a material having an inside surface and an outside surface; said outer panel having at least one fastening member around its inside periphery that is complimentary to a fastening member on said container's outside surface wherein said outer panel is hingedly attached to the container by said container's outside surface fastening means, to at least partially cover said opening.

34. The invention as claimed in claim 33, wherein said interactive article carried by an individual further includes:

at least one inner panel having an interior surface and an exterior surface and an interior and exterior periphery;

said inner panel having at least one fastening member around its exterior periphery to releasably attach said inner panel to a corresponding fastening member of said fastening means around the periphery of the opening on the inside surface of the container, thereby attaching said inner panel to the container.

35. The invention as claimed in claim 34, wherein said interactive article carried by an individual further includes:

said at least one inner panel having an exterior surface providing a means for bearing indicia, a different colored surface or different texture than said container's outside surface at the carrier's preference;

said inner panel being removable and replaceable with other inner panels and thereby changing said indicia, color or texture of said container at the area of the container where the inner panel is attached;

said inner panel being covered and uncovered by said outer panel and is positioned adjacent to the inside surface of said outer panel when both said inner panel and said outer panel are attached to said container and said outer panel is in a closed position.

36. The invention as claimed in claim 35, wherein said outer panel has one edge that is free of a fastening member and is fixedly attached to said container, forming a permanent hinge.

37. The invention as claimed in claim 32, wherein said interactive article carried by an individual further includes:

at least one outer panel having an inside and an outside periphery and constructed of a material having an inside surface and an outside surface; said outer panel having at least one fastening member around its inside periphery that is complimentary to a fastening member on an inner panel;

at least one inner panel having an interior surface and an exterior surface and an interior and exterior periphery;

said at least one inner panel having at least one fastening member around an exterior periphery to releasably attach said inner panel to a corresponding fastening member of said fastening means on the inside surface of said container opening thereby attaching said inner panel to the container;

said at least one inner panel having at least a second fastening member on its exterior surface to releasably attach the inner panel to a complementary fastening member on said outer panel whereby the outer panel is hingedly attached to said inner panel to at least partially cover said opening when the inner panel is attached to said container;

said inner panels being covered and uncovered by said outer panel and is positioned adjacent to the inside surface of said outer panel when said outer panel is attached to said inner panel in a closed position.

38. The invention as claimed in claim 37, wherein said outer panel has one edge that is free of a fastening member and is fixedly attached to said container, forming a permanent hinge.

39. The invention as claimed in claim 37, wherein said outer panel has a material that is a continuation and extension of said container material forming a periphery and a body of said outer panel.

40. The invention as claimed in claim 37, wherein said outer panel has a fastening member that is fixedly attached to its inside periphery and completely encompasses said outer panel.

41. The invention as claimed in claim 37, wherein said outer panel has an inside surface providing a means for bearing indicia, a different colored material or a different textured material than said container's outside surface at the carrier's preference.

42. The invention as claimed in claim 32, wherein said container is a gym bag.

43. An interactive article carried by an individual comprised, in combination of a container constructed of a material and having an inside surface and an outside surface;

said container having at least one first fastening means fixedly attached to said outside surface and said first fastening means is straddled by at least a second fastening means;

said container having at least one second fastening means fixedly attached to said outside surface, with at least one fastening member that angles or bends and ultimately provides said second fastening means with a frame shape that would be necessary for its shape to eventually surround said first fastening means and whereby said second fastening means' frame shape is located around said first fastening means;

at least one panel having an inside and outside periphery and constructed of a material having an inside surface and an outside surface and at least one fastening member around its periphery on the inside surface, that is complimentary to at least one of the said fastening means on said container's outside surface, whereby said panel is hingedly attached to the container by one of the said fastening means.

44. The invention as claimed in claim 43, wherein said at least one panel is:

an outer panel having said at least one fastening member around its periphery on the inside surface complimentary to said second fastening means on said container's outside surface, whereby said outer panel is hingedly attached to the container by said second fastening means.

45. The invention as claimed in claim 44, wherein said interactive article carried by an individual further includes:

at least one inner panel having an interior surface and an exterior surface;

said inner panel having at least one fastening member on its interior surface that is complementary to said first fastening means on said container's outside surface, thereby releasably attaching said inner panel to the container in a position that is adjacent to the inside surface of said outer panel and that is at least partially covered by said outer panel when the outer panel is attached to said container in a closed position.

46. The invention as claimed in claim 45, wherein said outer panel has an outside surface providing a means for bearing indicia, a different colored surface or different texture than said container's outside surface at the carrier's preference.

47. The invention as claimed in claim 46, wherein said inner panel has an exterior surface providing a means for bearing indicia, a different colored surface or different texture than said container 'outside surface at the carrier's preference.

48. The invention as claimed in claim 47, wherein said inner panel is removable and replaceable with other inner panels and;

said inner panel being covered and uncovered by said outer panel, removed and replaced by other inner panels thereby changing said indicia, color or texture of said container at the area of the container where the inner panel is attached.

49. The invention as claimed in claim 43, wherein said second fastening means at least partially surrounds said first fastening means.

50. The invention as claimed in claim 43, wherein said second fastening means completely surrounds said first fastening means.

51. The invention as claimed in claim 44, wherein said outer panel has one edge that is free of a fastening member and is fixedly attached to said container, forming a permanent hinge.

52. The invention as claimed in claim 44, wherein said outer panel has at least one fastening member that is fixedly attached to its inside periphery and completely encompasses said outer panel.

53. The invention as claimed in claim 44, wherein said outer panel has an inside surface providing a means for bearing indicia, a different colored material or a different texture than said container's outside surface and said inner panel's exterior surface at the carrier's preference.

54. The invention as claimed in claim 43, wherein said at least one panel has:

at least one fastening member on its inside surface that is complementary to said first fastening means on said container whereby said panel is hingedly attached to the container's outside surface.

55. The invention as claimed in claim 43, wherein said container is a back pack.

* * * * *